US005309748A

United States Patent [19]

Jarrett et al.

[11] Patent Number: 5,309,748

[45] Date of Patent: May 10, 1994

[54] METAL EXTRUSION

[75] Inventors: Martin R. Jarrett, Southam; William Dixon, Egremont, both of Great Britain

[73] Assignee: Alcan International Limited, Montreal, Canada

[21] Appl. No.: 836,347

[22] PCT Filed: Sep. 18, 1990

[86] PCT No.: PCT/GB90/01434

§ 371 Date: Mar. 3, 1992

§ 102(e) Date: Mar. 3, 1992

[87] PCT Pub. No.: WO91/04110

PCT Pub. Date: Apr. 4, 1991

[30] Foreign Application Priority Data

Sep. 18, 1989 [GB] United Kingdom ..... 8921079

[51] Int. Cl.[5] ..... B21C 23/01

[52] U.S. Cl. ..... 72/256; 428/585

[58] Field of Search ..... 72/256, 270; 428/583, 428/585

[56] References Cited

U.S. PATENT DOCUMENTS

| | | | |
|---|---|---|---|
| 2,080,640 | 5/1937 | Templin | 72/256 |
| 2,781,903 | 2/1957 | Buffet et al. | 72/256 |
| 3,802,243 | 4/1974 | Wessel . | |
| 3,874,213 | 4/1975 | Sperry et al. . | |

FOREIGN PATENT DOCUMENTS 769604 3/1957 United Kingdom .

*Primary Examiner*—Lowell A. Larson
*Attorney, Agent, or Firm*—Cooper & Dunham

[57] ABSTRACT

A billet of extrudable metal, particularly an Al alloy is tapered at its back end. The billet is compressed longitudinally so that the metal of the tapered end is upset transversely. The compressed billet is hot extruded. The upsetting improves the fracture toughness of the back end of the extrusion. This is useful in long extrusions for the aircraft industry.

13 Claims, 2 Drawing Sheets

METAL EXTRUSION

FIELD OF THE INVENTION

The present invention is concerned with a method of producing extrusions and particularly with the production of long metal extrusions having uniform mechanical properties along the entire length of the extruded section.

BACKGROUND OF THE INVENTION

There is a need within the aircraft and construction industries for long aluminium extrusions having a high and uniform fracture toughness throughout the length of the extrusion. However using conventional extrusion processes it is found that the fracture toughness may be reduced towards the back-end of the extrusion. The longer the extrusion the worse the problem becomes. In order to obtain extrusions having adequate fracture toughness along their length it is necessary either to discard a large portion from the back-end of the extrusion or for ease of production to discard a large part from the rear end of the billet. Since the size of billets is limited to those which can be accommodated by the extrusion press, the size of extrusions which can be reliably produced is also limited.

If a billet of smaller diameter than the internal diameter of the container of the extrusion press is used the extrusion ram compresses the billet along its length and the billet metal is displaced in a transverse direction to fill the container. This process is known as upsetting. It is known to increase the transverse ductility of extrusions by introducing a small degree of upset along the entire length of the extrusion billet.

U.S. Pat. No. 3455134 describes the use of tapered billets in a hydrostatic extrusion process. The billets remain tapered during extrusion and are not upset.

GB 769604 is concerned with the hot working of alloys which are not normally extrudable. A billet which may be frusto-conical is compressed axially, and then extruded with the head of the ingot extruded last. The purpose of the method is to reduce loss of metal as scrap.

SUMMARY OF THE INVENTION

The present inventors have now discovered that by use of billets having a tapered back-end a differential upset may be applied to the billet and extrusions may be produced which have improved fracture toughness along their length. Accordingly, the present invention provides a method of producing an extrusion which method comprises providing a billet of extrudable metal, said billet having an untapered part and a back end which has a reduced cross-section along at least part of its length, the cross-sectional area of the billet at the back-end being up to 90% of the cross-sectional area of the untapered part of the billet, compressing the billet along its length such that the metal of the back-end of the billet is upset in a transverse direction, and extruding the compressed billet.

BRIEF DESCRIPTION OF THE DRAWINGS

Further features and advantages of the invention will become apparent to those of ordinary skill in the art upon reviewing the detailed description of the invention in conjunction with the appended drawings in which.

DETAILED DESCRIPTION OF THE INVENTION

Figure 1A:
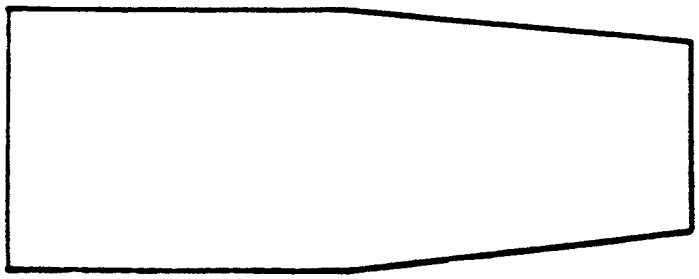
FIGS. 1A through D are side views of tapered metal extrusion billets prepared in accordance with the present invention.
Figure 1B:
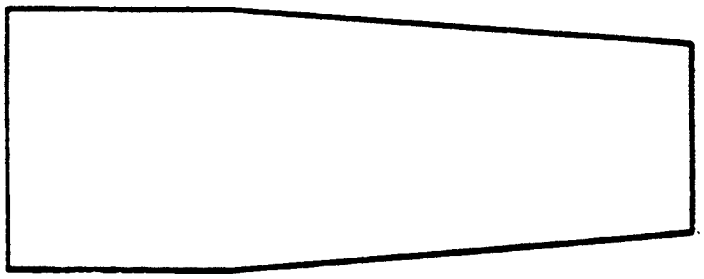
Figure 1C:
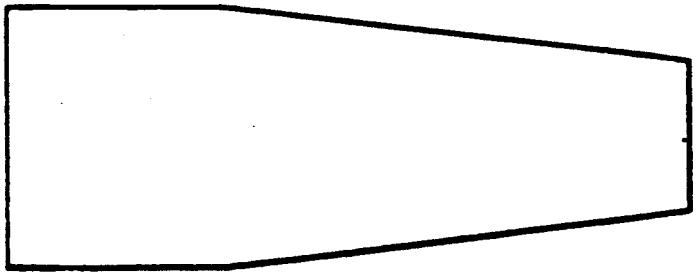
Figure 1D:
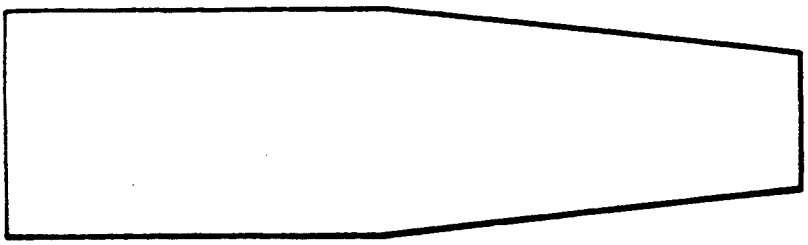

The present invention is illustrated with particular reference to aluminium and aluminium alloys. However the present invention is not limited to aluminium but is applicable to other extrudable metals.

The invention also provides a billet of extrudable metal for use in the extrusion process which has a reduced cross-section along at least part of its length such that the cross-sectional area at one end is up to 90% of the cross-sectional area of the untapered part of the billet wherein the billet is of a 2000, 5000, 6000, 7000 series alloy or 8090 or 8091 aluminium alloy or that sold under the Trade Mark Weldalite 049.

In a further aspect of the invention there is provided an extrusion of a metal having a volume of metal of at least 60% of that of the billet from which it was extruded and having a substantially uniform fracture toughness along its entire length.

The present invention is applicable to both direct and indirect extrusion processes and to both solid and hollow extruded sections. The extrusion process is preferably hot extrusion.

The present invention can be applied to any extrudable metal containing at least one second phase. It is believed that the differential upsetting introduced by the process of the present invention alters the distribution of the second phase and mitigates its effects on the transverse properties. The word metal is here used to include any extrudable metal or alloy including duplex stainless steels brass and metal matrix composites such as those produced by mixing liquid metal and a solid phase, see for example GB 1379261, and spray cast alloys and alloys produced by powder metallurgy.

The present invention is applicable to any metals which are normally extrudable without differential upsetting, i.e. those which can be extruded after homogenisation if required in a conventional press without cracking.

A particularly preferred metal is aluminium which includes the metal and its alloys. The 2000, 5000 and 7000 series alloys are preferred, as are AlLi alloys such as 2090, 2091, 8090, 8091 and that sold under the Trade Mark Weldalite 049 . Alloys of the 6000 series are also included although they may not be suitable for more demanding aerospace applications.

The method preferably involves use of a billet whose back-end has a tapered cross-section along at least part of its length. The tapered billet allows upsetting of the metal in the tapered region of the billet but the front-end may remain essentially unaffected or may itself be upset to a lesser extent. By tapering the billet a differential upset is achieved whereby the degree of upset is increased progressively or stepwise towards the rear of the billet. The billet, particularly when of an aluminium alloy, is preferably homogenised prior to upsetting.

The present inventors have found that the grain size distribution across the extrusion section (determined transversely) is dependent upon both the original billet grain structure and the strain history during extrusion. A fine fibritic grain structure in association with a high density of insoluble second phase particles (e.g. $Cu_2FeAl_7$, $CuMgAl_2$) results in semi-continuous stringers which reduce toughness. Fracture propagation proceeds along intergranular boundaries and also along stringers The upset introduced into the tapered section of the billet metal increases the distance between grain boundaries and stringers and (it is believed) thereby reduces crack propagation and increases fracture toughness. This process may also alter the substructure. Other mechanical properties in the transverse directions, for example UTS, ductility and fatigue strength, may also be improved.

A taper may be applied to the back-end of the billet such that the end of the billet has a cross-sectional area of up to 90% e.g. from 10 to 90% of the cross-sectional area of the front-end of the billet. Preferably the cross-sectional area of the back-end of the billet is from 15 to 70% of the front-end.

The taper is preferably applied to at least 25% of the length of the billet but may be applied to essentially the whole length of the billet. Tapering may be e.g. uniform or stepwise.

Billets used for extrusion will normally have a circular cross-section to which the taper may be applied by machining. The taper may be applied about the whole circumference of the billet to produce a conical taper. Alternatively the machining may be applied such that one or more inclined (to the longitudinal axis of the billet) faces are formed.

The extent of the taper determines the degree of upset, which in turn determines the proportion by which rear end fracture toughness is increased.

The use of a tapered billet means that the entire working volume of the cylindrical container of the extrusion press is not filled Thus the volume of metal that can be extruded and hence the length of extrudate would be smaller than with a cylindrical billet of equivalent length. Even if long extrusions are not required the efficiency of the extrusion press may be reduced relatively. In order to overcome this the tapered billet may be upset prior to insertion into the extrusion press. This may most conveniently be done by hot forging the tapered billet so as to compress it in a longitudinal direction. Forging produces a billet of an essentially cylindrical shape from the tapered billet having the required degree of upset in the back-end of the billet. Alternatively the tapered billet may be arranged to be somewhat longer than the container of the extrusion press, so that upsetting may be accomplished by initial movement of the extrusion ram.

Particularly for the aerospace applications mentioned above, long extrusions having substantially uniform fracture toughnesses along their entire length are difficult to obtain. Extrusions produced according to the present invention however, have substantially uniform fracture toughness, particularly in the short longitudinal (SL) and transverse longitudinal (TL) direction, along their entire lengths, typically within ±20% and preferably within ±10% of the average value. Extrusions having lengths of at least 6 meters up to 10 meters or even more are easily produced having substantially uniform fracture toughness along their length.

With conventional extrusion processes performed on high strength alloys for demanding areospace applications, typically 15% or more of the back-end of the extrusion billet will be discarded. Since the volume of the extrusion billet is limited to the size of billet which can be held by the container this means that the high proportion of the available metal which must be discarded puts a limit on the maximum length of the extrusion. The present invention however allows more of the billet to be used, typically only 10% of the billet need be discarded. Extrusions according to the present invention have a volume of metal of at least 60% of that of the billets from which they were extruded. More usually they will comprise from 65 to 90% of the volume of metal of the billet from which they were extruded.

Typically the TL fracture toughness of specimens taken from the rear end of long extrusions produced according to conventional processes from the aluminium alloys noted above can be in the region of $15MNm^{-3/2}$ or less. Extrusions according to the present invention will typically have a TL fracture toughness of $18MNm^{-3/2}$ along their entire length and fracture toughnesses in excess of $20MNm^{-3/2}$ are achieveable.

Reference is directed to the accompanying drawings in which:

Each of FIGS. 1A, B and C is a side elevation of an extrusion billet as used in Examples 1 and 2 below.

Figure 2A:
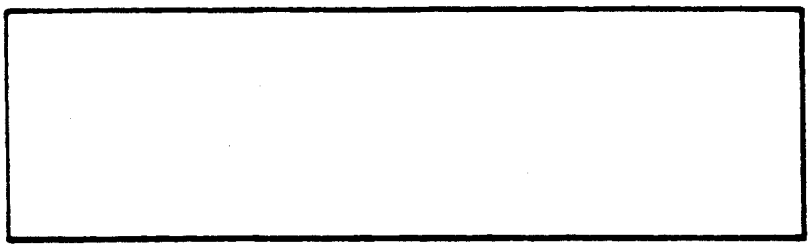
FIG. 2A and B are views of another tapered metal extrusion billet prepared in accordance with the present invention.

FIGS. 2A, B, and C comprise three orthogonal views of a type D extrusion billet used in Example 3.

The following Examples illustrate the invention.

EXAMPLE 1

Tapered extrusion billets of 7150 alloy were prepared according to the profiles shown in FIG. 1 (in which dimension are in mm). The taper was applied by machining the cylindrical billets to give a circumferential taper. The billets were then extruded as 158×72 mm solid sections approximately 10 m long. The extrusions were solution heat treated, stretched and 0.5 m cut from each end to remove stretcher jaw marks, and then fully aged.

Fracture toughness was tested using the ASTM 399/83 test procedure to determine the TL fracture toughness of the extrusions measured at the back-end of the extrusion (after removal of the stretcher jaw marks).

| | Discard* % | Fracture toughness ($MNm^{-3}$) (average of two tests) |
|---|---|---|
| Conventional billet | 15 | 15.0 |
| Taper design A | 10 | 18.16 |
| Taper design B | 10 | 18.35 |
| Taper design C | 10 | 21.06 |
| Taper C | 7.5 | 18.55 |

*Length of billet left in container divided by length of original billet before upsetting times 100.

Further tests were conducted along the length of the extrusion produced from two billets of taper C.

| Distance from back-end ($MNm^{-3/2}$) (metres) + | T.L Fracture toughness C |
|---|---|
| 2 | 20.2 |
| 4.6 | 19.7 |

+ after removal of stretcher jaw marks.

EXAMPLE 2

A 7150 alloy billet to taper design C but with a parallel portion of 650 mm a tapered portion of 700 mm and overall length of 1350 mm was heated to 400° C. and compressed longitudinally between flat dies until the cross-sectional area towards the back-end was the same as that of the original untapered part. The resulting billet was essentially cylindrical.

After cooling to room temperature, the billet was then pre-heated to 400 ° C. and placed in the extrusion press (original taper position to the rear). The billet was subsequently extruded into the same section as that for example 1. Because of the increased billet volume the final extruded length in this case was 14 m. The extrusion was then solution heat treated, stretched and 0.5 m cut from each end to remove stretcher jaw marks and then fully aged.

Fracture toughness was tested using ASTM 399/83 test procedures to determine the transverse T.L. fracture toughness of the extrusion at a number of locations along the extruded length. These results are shown in Table 2 (Forged).

Table 2 also gives T. L. fracture toughness results obtained from the rear of an extrusion of the same length where the billet, to Design C and also having a parallel portion of 650mm, a tapered portion of 700mm and overall length of 1350mm, was processed in the same manner as for example 1 i.e. the tapered billet was placed in the extrusion press and upset at the press.

TABLE 2

| Taper Design C (Forged) | | Taper Design C (Upset at press) | |
|---|---|---|---|
| Distance from Front End of Extrusion in m. | Fracture Toughness $MNm^{-3/2}$ | Distance from Front End of Extrusion in m. | Fracture Toughness $MNm^{-3/2}$ |
| 1.7 | 18.75 | 12.6 | 19.5 |
| 3.5 | 18.8 | 12.6 | 19.1 |
| 5.3 | 18.75 | 12.6 | 18.9 |
| 7.1 | 18.5 | 12.6 | 18.6 |
| 8.8 | 19 | 12.6 | 18.2 |
| 10.5 | 18.7 | | |
| 12.6 | 18.4 | | |

EXAMPLE 3

Figure 2B:
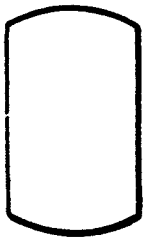

7150 alloy billets of Taper design according to the profile shown in FIG. 2—Design D, wedge billet—were prepared. The billets were then extruded as 212 mm × 90 mm solid sections approximately 9 m long. The extrusions were solution treated, stretched and 0.5 m cut from each end to remove stretcher jaw marks, and then fully aged.

Fracture toughness was tested using the ASTM 399/83 test procedure to determine the transverse TL fracture toughness of the extrusions measured at the back-end of the extrusion (after removal of the stretcher jaw marks).

| | Discard | Fracture Toughness $MNm^{-3/2}$ |
|---|---|---|
| Conventional Billet | 15% | 14.0 |
| Taper Design D | | |
| (i) | 10% | 18.0 |
| (ii) | 10% | 18.5 |

We claim:

1. A method of producing an extrusion, which method comprises providing a billet of extrudable metal said billet having an untapered part towards its front end and a back end which has a reduced cross section along at least part of its length, the cross-sectional area of the billet at the back end being up to 90% of the cross-sectional area of the untapered part of billet, compressing the billet along its length such that the metal of the back end of the billet is upset in a transverse direction, and extruding the compressed billet.

2. A method according to claim 1 wherein the billet is tapered along at least 25% of its length.

3. A method according to claim 1 wherein the taper is a circumferential taper.

4. A method according to claim 2 wherein the back-end of the billet is tapered by virtue of having one or more faces inclined to its longitudinal axis.

5. A method according to claim 1 wherein the billet is upset along the length of the tapered section within the extrusion press.

6. A method according to claim 1 wherein the billet is upset along the length of the tapered section prior to insertion into the extrusion press.

7. A method according to claim 1 wherein the billet is aluminum or an alloy thereof.

8. A method according to claim 1 wherein the billet is a 2000, 5000, 6000, 7000 series alloy or 8090 or 8091 alloy or Weldalite 049.

9. A billet of extrudable metal for use in the method of claim 1, which billet has an untapered part towards its front end and a back end which has a reduced cross-section along at least part of its length such that the cross-sectional area at one end is up to 90% of the cross-sectional area of the untapered part of the billet, wherein the billet is of a 2000, 5000, 6000, 7000 series alloy or 8090 or 8091 aluminum alloy of Weldalite 049.

10. A billet according to claim 9 wherein the billet is tapered along at least 25% of its length.

11. A billet according to claim 10 wherein the taper is a circumferential taper.

12. A billet according to claim 10 wherein the back-end of the billet is tapered by virtue of having one or more faces inclined to its longitudinal axis.

13. A billet according to claim 9 which has further been compressed along its length, the metal of the tapered section being upset in a transverse direction such that the billet has an essentially uniform cross section.

* * * * *